US007670650B2

(12) United States Patent
Chen et al.

(10) Patent No.: US 7,670,650 B2
(45) Date of Patent: Mar. 2, 2010

(54) METHOD FOR PRODUCING A REPLACEABLE FUSER MEMBER

(75) Inventors: Jiann-Chen Chen, Fairport, NY (US); Biao Tan, Penfield, NY (US); Allen Kass, Pittsford, NY (US); Garold F. Fritz, Williamson, NY (US); Steven O. Cormier, West Henrietta, NY (US); Ralph E. Williams, Rochester, NY (US); Joseph A. Pavlisko, Pittsford, NY (US)

(73) Assignee: Eastman Kodak Company, Rochester, NY (US)

( * ) Notice: Subject to any disclaimer, the term of this patent is extended or adjusted under 35 U.S.C. 154(b) by 881 days.

(21) Appl. No.: 10/662,913

(22) Filed: Sep. 15, 2003

(65) Prior Publication Data

US 2004/0165920 A1 Aug. 26, 2004

(51) Int. Cl.
*B05D 1/36* (2006.01)
*B05D 3/02* (2006.01)
*B21D 53/00* (2006.01)

(52) U.S. Cl. ..... 427/402; 427/407.1; 427/409; 427/410; 427/379; 427/385.5; 29/895; 29/895.21; 29/895.32

(58) Field of Classification Search ..... 427/402, 427/407.1, 409, 410, 379, 385, 385.5; 29/895, 29/895.21, 895.32
See application file for complete search history.

(56) References Cited

U.S. PATENT DOCUMENTS 3,146,709 A * 9/1964 Bass et al. ..... 101/375
3,552,898 A * 1/1971 Bird et al. ..... 228/193
3,751,216 A * 8/1973 Gregory ..... 432/62
3,799,859 A * 3/1974 Wallin ..... 204/216
3,927,463 A * 12/1975 Dupree et al. ..... 29/447
3,950,839 A * 4/1976 DuPree et al. ..... 29/447
4,119,032 A * 10/1978 Hollis ..... 101/216
4,853,737 A * 8/1989 Hartley et al. ..... 399/333
5,021,109 A * 6/1991 Petropoulos et al. ..... 156/137
5,141,788 A * 8/1992 Badesha et al. ..... 428/36.8
5,415,961 A * 5/1995 Yu et al. ..... 430/58.05
5,750,160 A * 5/1998 Weber et al. ..... 425/290
5,781,840 A * 7/1998 Chen et al. ..... 430/97
5,995,796 A * 11/1999 Schlueter et al. ..... 399/313
6,071,110 A * 6/2000 Mikkelsen ..... 425/327
6,259,873 B1 * 7/2001 Shifley et al. ..... 399/110
6,355,352 B1 3/2002 Chen et al. ..... 428/421
6,393,249 B1 5/2002 Aslam et al. ..... 399/333
6,429,249 B1 8/2002 Chen et al. ..... 524/432

FOREIGN PATENT DOCUMENTS

JP 2000131864 A * 5/2000

* cited by examiner

*Primary Examiner*—Elena T Lightfoot
(74) *Attorney, Agent, or Firm*—Lawrence P. Kessler; Carl F. Ruoff; Andrew J. Anderson

(57) ABSTRACT

A method for producing a replaceable fuser member including a thin, seamless or welded high temperature nickel sleeve, a base cushion positioned around the sleeve and an outside topcoat applied over the base cushion elastomer layer. The sleeve is replaceable on a machine mandrel positioned in an electrophotographic copying machine in a fuser section of the electrophotographic copying machine. The method includes the use of a mandrel having a coefficient of thermal expansion similar to that of the sleeve to support the sleeve during positioning of a cured base cushion layer around the sleeve and a cured topcoat layer over the cured base material.

19 Claims, No Drawings

METHOD FOR PRODUCING A REPLACEABLE FUSER MEMBER

CROSS REFERENCE TO RELATED APPLICATIONS

Reference is made to the following co-pending, commonly assigned application, the disclosure of which is incorporated herein by reference:

U.S. Pat. No. 7,115,084, issued on Oct. 3, 2006, by Chen, et al., entitled, "REPLACEABLE FUSER MEMBER".

FIELD OF THE INVENTION

This invention relates to a method for producing a replaceable fuser member. The replaceable fuser member includes a thin, seamless or welded high temperature nickel sleeve, a base cushion positioned around the sleeve and an outside low surface energy coating applied over the base cushion elastomer layer. The sleeve is replaceable by installation on a mandrel positioned in a fuser section of an electrophotographic copying machine. The sleeve is produced by a process including mounting the high temperature nickel sleeve on a mandrel, thereafter applying a coating of primer on the outside of the sleeve, applying a coat of a base cushion elastomer around the outside of the sleeve, curing and machining the base cushion elastomer to a desired thickness and thereafter applying a coating of a topcoat layer over the base cushion and curing the topcoat layer to produce the replaceable fuser member.

BACKGROUND OF THE INVENTION

In electrophotographic copying, an electrostatic latent image is formed on a primary image-forming member such as a photoconductive surface and is developed with a thermoplastic toner powder to form a toner image. The toner image is thereafter transferred to a receiver such as a sheet of paper, plastic or the like and the toner image is subsequently fused to the receiver in a fusing station using heat, pressure or both. The fuser station includes fuser members, which typically are rollers, although fuser belts and the like may also be used. The essential function performed in the fusing station is application of heat and pressure to the toner image on the receiver to fix the image to the receiver.

The fusing step is commonly carried out by passing the toner image-bearing receiver between a pair of engaged rollers that produce an area of pressure contact known as a fusing nip. In order to form the nip, at least one of the rollers typically includes a compliant or conformable layer. Heat is transferred from at least one of the rollers to the toner in the fusing nip causing the toner to partially melt and attach to the receiver. In the case where the fuser member is a heated roller, a resilient compliant roller having a smooth surface is typically used.

Where the fuser member is in the form of a belt, such as a flexible endless belt that passes around the heated roller, it typically has a smooth, hardened outer surface.

Most fuser stations, which are known as simplex fusers, attach toner to only one side of the receiver at a time. In such fusers, it is common for a first one of the two rollers to be driven rotatably by an external source. The second roller is then rotatably driven by frictional contact with the first roller. Similarly, heat is typically applied to only one of the rollers. The heat may be applied by the use of one or more heater rollers to heat the exterior of the heated fuser roller or the heat may be supplied internally to the heated fuser roller.

Two basic types of heated rollers have been used. One uses a conformable or compliant pressure roller to form a fusing nip against a hard, heated fuser roller. The other uses a compliant fuser roller to form the nip against a hard, heated and relatively non-conformable pressure roller. A fuser roller designed as compliant typically includes a conformable layer having a thickness greater than about 2 millimeters (mm) and in some instances greater than about 25 mm. A fuser roller designated as "hard" includes a rigid cylinder that may have a relatively thin polymeric or conformable elastomeric coating less than about 1.25 mm thick on its exterior. There are certain advantages associated with both compliant and non-compliant rollers.

Typically, fuser rollers include a conformable layer that may be formed of any suitable material such as, for instance, polydimethylsiloxane elastomer.

Typically, toner fuser rollers include a hollow cylinder core, which is often metallic, with a roller cushion layer formed about the roller. Such cushion layers are commonly made of silicone rubbers or silicone polymers having a low surface energy such as polydimethylsiloxane, which minimize adherence of toner to the roller, especially the heated roller. It is also known that cured polyfluorocarbon polymers and copolymers may be used to coat the cushion layer surface to further reduce the tendency of the toner to adhere to the roller and minimize contact of release oils with the cushion layer.

The cushion layer may include fillers including inorganic particles such as metals, metal oxides, metal hydroxides, metal salts, mixtures thereof and the like. These materials function to improve the thermoconductivity of the cushion layer.

The filler particles may also strengthen or otherwise modify the physical properties of the cushion material. A wide variety of rollers have been produced in attempts to more economically produce rollers that are more effective in selected desired applications. For instance, one such roller for use in a fuser station and including a flexible strengthening band, a base cushion layer around the strengthening band, a stiffening layer around the base cushion and a release layer around the stiffening layer is disclosed in U.S. Pat. No. 6,393,249B1 issued May 21, 2002, to Muhammed Aslam, et al. and assigned to NexPress Solutions, LLC. This patent is hereby incorporated by reference.

It is also known that various fluoropolymers, such as thermoplastic fluorocarbon polymers and random copolymers, are useful as coatings on such rollers. Some such fluorocarbon thermoplastic polymers and thermoplastic random copolymers, including various additive materials, are disclosed in U.S. Pat. No. 6,355,352B1 issued Mar. 12, 2002, to Jiann-Hsing Chen, et al. and assigned to NexPress Solutions, LLC and U.S. Pat. No. 6,429,249B1 issued Aug. 6, 2002, to Jiann-Hsing Chen, et al. and assigned to NexPress Solutions, LLC. These patents are hereby incorporated by reference.

While silicone rubbers and silicone polymers have been used widely as cushion layers, they have also, in some instances, been used as an exterior layer. Fluoroelastomers and rubbers such as rubbers made of ethylene propylene diene monomers and the like have also been used as cushion layer materials. Unfortunately in many fusing processes the exterior of the fuser roller, in direct contact with the toner, particularly a heated fuser roller, is coated with a release oil during fusing. Such release oils are generally detrimental to the silicone rubbers and silicone polymers. Polyfluorocarbon polymers and random copolymers coated over the outside of the cushion layer have been found to be resistant to such oils and to provide a low energy surface which readily releases from the toner on the receiver and are not adversely affected by commonly used release oils.

Continued efforts have been directed to the development of methods for the fabrication of replaceable fuser members for fuser rollers in electrophotographic applications. Increased ease of installation and reduced replacement, are major factors that have been the object of continuing efforts for improvement. Particularly, efforts have been directed to improvements in the fabrication process whereby good adhesion is provided between the layers of cured material including the member and whereby a consistent fit of the replacement member over the machine mandrel is achieved.

SUMMARY OF THE INVENTION

According to the present invention, it has been found that a superior replaceable fuser roller member adapted to be positioned on a machine mandrel in a fuser system of an electrophotographic machine to function as a roller in the electrophotographic machine is produced by a method including: mounting a high temperature nickel sleeve having an inside and an outside and a coefficient of thermal expansion on a mandrel having an outside, being configured to receive the sleeve over the outside of the mandrel and having a coefficient of thermal expansion equal to from about 80 to about 120 percent of the coefficient of thermal expansion of the sleeve in a temperature range from about 20 to about 325° C.; applying a coating of a primer including a silane coupling agent containing epoxies to the outside of the sleeve; applying a coating of a base cushion elastomer around the outside of the sleeve; curing the base cushion elastomer; machining the coating of the cured base cushion elastomer to a desired thickness; applying a topcoat layer over the machined coating of the base cushion; curing the topcoat layer; and, removing the replaceable fuser member from the mandrel.

The present invention further includes: an improvement in a method for producing a replaceable fuser member adapted to be positioned on a machine mandrel in a fuser system of an electrophotographic machine to function as a roller in the electrophotographic machine by mounting a high temperature nickel sleeve on a mandrel configured to receive the sleeve over the outside of the mandrel: applying a coating of a primer including a silane coupling agent containing epoxies to the outside of the sleeve; applying a coating of a base cushion elastomer around the outside of the sleeve; curing the base cushion elastomer; machining the cured base cushion elastomer to a desired thickness; applying a topcoat layer over the machined base cushion; curing the topcoat layer and removing the replaceable fuser member from the mandrel; the improvement including: forming the mandrel of a metal having a coefficient of thermal expansion equal to from about 80 to about 120 percent of the coefficient of thermal expansion of the sleeve in a temperature range from about 20 to about 325° C.

The use of a metal mandrel having a coefficient of thermal expansion equal to from about 80 to about 120 percent of the coefficient of thermal expansion of the sleeve permits curing the cushion layer and the topcoat layer at temperatures up to at least 300° C. without distortion of the sleeve by unacceptable expansion of the mandrel or loosening of the sleeve by greater thermal expansion of the sleeve than the mandrel. This results in the production of a replaceable fuser member having a very closely controlled inside diameter of the sleeve that facilitates closely mating engagement with the machine mandrel in the fuser system.

DETAILED DESCRIPTION OF THE INVENTION

According to the present invention, a method of producing a replaceable fuser roller member adapted to be positioned on a machine mandrel in a fuser system of an electrophotographic machine to function as a roller in the electrophotographic machine is provided. The method including: mounting a high temperature nickel sleeve having an inside and an outside and a coefficient of thermal expansion on a mandrel having an inside and an outside, being configured to receive the sleeve over the outside of the mandrel and having a coefficient of thermal expansion equal to from about 80 to about 120 percent of the coefficient of thermal expansion of the sleeve in a temperature range from about 20 to about 325° C.; applying a coating of a primer including a silane coupling agent containing epoxies to the outside of the sleeve; applying a coating of a base cushion elastomer around the outside of the sleeve; curing the base cushion elastomer; machining the coating of the cured base cushion elastomer to a desired thickness; applying a topcoat layer over the machined coating of the base cushion elastomer; curing the topcoat layer; and, removing the replaceable fuser member from the mandrel.

The sleeve has typically been of any of a wide variety of metals, such as aluminum, elastomers, plastic, silicone and the like. Desirably, the metal sleeve is a high temperature nickel. Nickel sleeves formed by electroforming nickel tend to outgas as the temperature is raised to the temperature necessary to cure the base cushion layer or the topcoat layer over the sleeve. As a result, it is highly desirable that the metal sleeve be of a high temperature nickel. High temperature nickel, as used in this application, refers to nickel that does not outgas, or release volatile compounds, at temperatures up to the maximum temperature required to cure the cushion layer and the topcoat elastomer layer over the fuser member. Such temperatures may be as high as, or even higher than 300° C.

Desirably, the machine mandrel is of the same metal as the sleeve. This is desirable so that the thermal expansion of the sleeve and the machine mandrel is closely matched. While some variation in thermal expansion can be tolerated, it is highly desirable that the expansion of the sleeve and the machine mandrel be approximately the same.

Desirably the sleeve is relatively thin. The reduced quantity of metal required for the thin sleeve contributes to the economical construction of the sleeve. Typical thicknesses of the sleeve are from about 0.001 to about 0.05 inches.

Typically, the sleeve is sized to slip over the machine mandrel with a relatively firm fit. Desirably, the inside of the metal sleeve has a diameter from about 0.001 to about 0.002 inches greater than the outer diameter of the machine mandrel. Greater tolerances may be necessary if the machine mandrel has a relatively rough surface. In general, it is desirable that the fuser member include a sleeve sized for ready positioning snugly around the machine mandrel in the electrophotographic machine so that the sleeve rotates with the machine mandrel. Sufficient tolerance should be provided to permit some thermal expansion of the machine mandrel greater than the expansion of the sleeve.

In the present invention, a primer including a silane coupling agent containing epoxies is positioned on the outside of the sleeve to provide good bonding between the base cushion and the sleeve. A variety of primers and adhesives have been used for this purpose, but it has been found that surprisingly superior results have been achieved with a particular primer. Particularly desirable results have been achieved when the sleeve is of a high temperature nickel. Typically the primer contains at least one of the group consisting of (3-glycidoxypropyl)-bis(trimethylsiloxy)methylsilane, 3-glycidoxypropylmethyldiethoxysilane, (3-glycidoxypropyl)methyldiethoxysilane, 3-glycidoxypropylmethyl-diisopropenoxysilane, 3-glycidoxypropylpentamethyldisiloxane, and 3-glycidoxypropyltrimethoxysilane. Such materials are commercially available as GE4044 primer which is available from the General Electric Corporation.

The primer is applied to the outside of the sleeve prior to placing the base cushion elastomer around the metal sleeve. Of the primers listed, (3-glycidoxypropyl)bis(trimethylsiloxy)methylsilane and (3-glycidoxypropyl)methyldiethoxysilane are preferred.

The base cushion may be formed of any suitable silicone rubber, silicone polymer, fluorocarbon polymers or copolymers, fluoroelastomers, or the like. Such materials are disclosed in U.S. Pat. No. 6,393,249B1, previously incorporated by reference. Such materials are considered to be well known to those skilled in the art and no novelty is claimed in the particular base cushion material selected. Preferably the base cushion material selected is a silicone resin or silicon rubber, since improved bonding is obtained using the primers with these materials. Surprisingly, superior adhesion has been achieved using these primers with high temperature nickel and silicone rubbers.

It is noted in U.S. Pat. No. 6,393,249B1, that a similar priming agent is used to secure a thick compliant base section to a strengthening band using GE4044 priming agent. This priming layer is used to bind the thick compliant cushion material to a flexible band having the form of a tubular belt, which may be metal, elastomer, plastic, or a reinforced material such as a fabric or a reinforced silicone belt. By contrast, the present invention uses a similar priming agent with a high temperature nickel and silicone rubbers and resins and with these materials achieve greatly superior results by comparison to previously used primers.

Positioned over the base cushion is an elastomer layer that can include any suitable low surface energy material suitable for the release of the toner images so that the toner images are not removed to any substantial extent from the receiver by the fuser roller.

In some instances, materials such as silicone rubber and the like have been used as the outer layer, but such materials are somewhat vulnerable to damage in long term use from release oil, which is typically applied to the heated fuser roller in fuser sections. Thermoplastic fluorocarbon polymers and thermoplastic fluorocarbon copolymers do not suffer this disadvantage. These materials have been found to be preferable to fluorocarbon resins, which do not have comparably low surface release energy. Typically, these thermoplastic fluorocarbon polymers and copolymers are positioned over the base cushion after sizing the base cushion to a desired size. They are then cured in place to produce the desired cured thermoplastic fluorocarbon polymer or copolymer surface as a cured surface. Such materials are well known to those skilled in the art, and as mentioned previously, have been disclosed in U.S. Pat. Nos. 6,355,352B1 and 6,429,249B1, both previously incorporated herein by reference.

Typically, the base cushion can vary in thickness from about 1 mm or less up to about 25 mm or more, dependent upon whether it is desired to produce a hard or a compliant roller. Such variations are known to those skilled in the art, as are the advantages of using either hard or compliant rollers. Similarly, the thickness of the cured thermoplastic fluorocarbon polymers and copolymers is typically from about 0.025 mm to about 0.25 mm or more. The thickness of these materials on the cushion layer is readily varied by changing the viscosity of the coating solution, the curing time, the coating method and the like, as well known to those skilled in the art.

By the method of the present invention, either hard or compliant replaceable fuser rollers can be produced without the need for additional layers, stiffening layers or the like.

The sleeve used in the method is of relatively simple construction but provides the flexibility to provide both hard and compliant rollers, which provide a low energy surface for the release of toner during the fusing step while providing simplicity of construction. The sleeve is a thin walled tubular sleeve, preferably of high temperature nickel. A major component of this simplicity is the ability to achieve the surprisingly superior bonding between the base cushion layer and the high temperature nickel using the primers discussed above. As demonstrated in the following example, surprising improvements in the adhesion of the base cushion to a high temperature nickel sleeve are achieved using the primers discussed above, particularly with silicone rubbers and silicone polymers.

According to the method of the present invention, the sleeve is placed on a mandrel for production of the fuser member. Desirably, the sleeve fits firmly over the outside of the mandrel and typically has a clearance between the inside of the sleeve and the outside of the mandrel from about 0.001 to about 0.002 inches. Desirably, the mandrel is of a metal having a coefficient of thermal expansion roughly the same as the sleeve. Typically the mandrel will be of a metal having a coefficient of thermal expansion from about 0.8 to about 1.2 times the coefficient of thermal expansion of the sleeve.

Preferably, the coefficient of thermal expansion of the mandrel is from about 0.9 to about 1.1 times the coefficient of thermal expansion of the sleeve. This permits some differential thermal expansion of the sleeve and mandrel without deforming the sleeve into an enlarged sleeve or a deformed sleeve. This also permits somewhat greater expansion by the sleeve without excessive looseness on the mandrel.

The sleeve is placed on the mandrel and thereafter coated with the primer to provide a primer-coated surface on the outside of the sleeve. The base cushion material is then applied over the primer to a thickness greater than a desired thickness on the outside of the sleeve. The base material, as noted previously, is typically a silicone rubber or a silicone polymer cured at a temperature up to about 205° C. for a time up to about 30 hours or more to produce a cured base cushion material. The cured base cushion material is then machined by grinding and polishing to a desired thickness. This thickness is typically from about 0.6 to about 50 mm, but is preferably from about 1 mm up to about 25 mm or more. The variation in thickness may be a function of whether it is desirable for the replaceable fuser member to provide a compliant or a hard roller.

The machining may be by any suitable method for reducing the thickness, i.e., grinding and polishing the base cushion material without damaging the remaining base cushion material. Such machining methods are well known to those skilled in the art.

After curing the base cushion material, a topcoat polymer, which is typically a thermoplastic fluorocarbon polymer or a thermoplastic fluorocarbon copolymer, is coated over the cured base cushion. This provides a coating on the exterior of the fuser member that provides a low energy surface resistant to the removal of toner and the like from the toner image bearing paper or the like.

The topcoat may be applied by any suitable method such as ring coating, spraying, transfer coating, or the like. The thickness of the topcoat layer is readily varied by changing the viscosity of the coating solution, the curing time, the curing speed, the coating method and the like. Such variations are well known to those skilled in the art. The topcoat is then cured up to a temperature of about 275° C. or more for a time up to about 5 hours or more. After curing the topcoat layer, the fuser member is complete and may be removed from the mandrel by differentially heating the fuser member or by differentially cooling the mandrel. Such variations are known to those skilled in the art.

The finished fuser member then has an inner diameter that is a proper size for placement on a machine mandrel to supply a replaceable exterior for a roller in a fusing section of an electrophotographic machine.

It is important that the primer used on the outside of the sleeve provide firm adhesion between the base cushion material and the sleeve. This primer should not result in the production of bubbles or other gases during curing of either the base cushion material or the topcoat material.

Similarly, it is necessary that the base cushion material be completely cured before the application of the topcoat so that gases are not generated from the base cushion layer during the curing of the topcoat. Any generation of gases between the layers results in poor adhesion and may result in a defective fuser member.

A more detailed description of the replaceable fuser member is described in co-pending, commonly assigned, U.S. Provisional Patent Application Ser. No. 60/433,144, filed Dec. 13, 2002, entitled, "REPLACEABLE FUSER MEMBER" by Jiann-Hsing Chen, Biao Tan, Joseph A. Pavlisko, Muhammed Aslam, Allen Kass and Nataly Boulatnikov.

Example 1

Metal samples of the compositions shown in Table 1 were prepared. These samples were prepared as metal plates having a size of about 4 inches by 8 inches. The surfaces of these metal surfaces were cleaned with ethanol and methylethylketone, thereafter GE4044 primer (a primer containing a silane coupling agent containing epoxies) was applied to these plates. Thereafter, a silicone rubber EC4952, available from Emerson and Cuming, Billerica, Mass., was coated onto the metal plates and the samples were cured for thirty hours as follows.

A twelve-hour ramp up time was used to reach a temperature of 205° C. and the temperature was held at 205° C. for eighteen hours. The adhesion of the silicone rubber to the test panels was tested with a peel test analyzer "Chatillion LTC M6," which was used to determine the adhesion values reported. The "Chatillion LTC M6" was obtained from Ametek Company, 8600 Somerset Drive, Largo, Fla. 33773.

A surprising improvement in adhesion was achieved with the high temperature nickel, and the bright chromate high-temperature nickel. With these materials, adhesion increases of eighteen to twenty fold were realized by comparison to unprimed plates. Much lesser improvements were realized with copper, copper-black oxide and electroformed nickel.

As shown in the following table, the high temperature nickel has more desirable properties for use in the production of replaceable fuser roller members than the electroformed nickel. Superior adhesion of the base cushion materials to the high temperature nickel is achieved using the primers discussed above. The method of the present invention provides the flexibility to produce hard or compliant rollers with a minimum of layers and with a sleeve configuration such that an electrophotographic machine user can readily replace the fuser roller member. Accordingly, the method of the present invention provides many advantages and improvements over previously known fuser roller and replacement fuser roller member production methods.

TABLE 1

| | SLEEVE COMPOSITION UNPRIMED (g) | AD-HESION PRIMED (g) | IMPROVE-MENT PRIMED/ UNPRIMED |
|---|---|---|---|
| COPPER | 16.06 | 5.17 | 0.32 |
| COPPER, BLACK OXIDE | 22.96 | 188.86 | 8.2 |
| BRIGHT CHROMATE | 7.39 | 154.60 | 20.9 |
| HIGH TEMPERATURE NICKEL | | | |
| HIGH TEMPERATURE NICKEL | 9.63 | 176.40 | 18.3 |
| NICKEL (ELECTROFORMING) | 6.02 | 25.93 | 4.3 |

The present method insures good layer adhesion and a good sleeve fit with the machine mandrel, provides for efficient and economical production and for wide flexibility in the layer thicknesses to provide hard or compliant replaceable fuser roller members as desired.

While the present invention has been described by reference to certain of its preferred embodiments, it is pointed out that the embodiments described are illustrative rather than limiting in nature and that many variations and modifications are possible within the scope of the present invention. Many such variations and modifications may be considered obvious and desirable by those skilled in the art based upon a review of the foregoing description of preferred embodiments.

What is claimed is:

1. A method for producing a replaceable fuser roller member, the replaceable fuser member being adapted to be positioned on a machine mandrel in a fuser system of an electrophotographic machine to function as a roller in the electrophotographic machine, the method comprising:

a) mounting a high temperature nickel sleeve having an inside and an outside on a mandrel having an outside, being configured to receive the sleeve over the outside of the mandrel and having a coefficient of thermal expansion equal to from about 80 to about 120 percent of the coefficient of thermal expansion of the sleeve in a temperature range from about 20 to about 325° C.;

b) applying a coating of a primer comprising a silane coupling agent that contains epoxies to the outside of the sleeve;

c) applying a coating of a base cushion elastomer around the outside of the sleeve;

d) curing the base cushion elastomer;

e) machining the coating of the cured base cushion elastomer to a desired thickness;

f) applying a topcoat layer over the machined coating of the base cushion;

g) curing the topcoat layer; and h) removing the replaceable fuser member from the mandrel.

2. The method of claim 1, wherein said primer contains at least one of the group consisting of, (3 glycidoxypropyl)bis (trimethylsiloxy)methylsilane, 3-glycidoxypropyldimethylethoxysilane, (3-glycidoxypropyl)methyldiethoxysilane, 3-glycidoxypropylmethyl-di-isopropenoxysilane, 3-glycidoxypropylpentamethyl-disiloxane, and 3-glycidoxypropyltrimethoxysilane.

3. The method of claim 2, wherein said primer contains at least one of the group consisting of, (3-glycidoxypropyl)bis (trimethylsiloxy)methylsilane and (3-glycidoxypropyl)dimethylethoxysilane.

4. The method of claim 1, wherein said mandrel has a coefficient of thermal expansion equal to from greater than 90 to 110% of the coefficient of thermal expansion of the sleeve.

5. The method of claim 1, wherein said sleeve is of a thickness from about 0.001 to about 0.05 inches.

6. The method of claim 1, wherein said desired thickness of the coating of the cured base cushion layer is from about 0.6 to about 50 mm.

7. The method of claim 1, wherein said base cushion coating is selected from the group consisting of silicone rubbers, silicon polymers, silicone rubbers containing fillers and silicone polymers containing fillers.

8. The method of claim 7, wherein said base cushion coating contains at least one filler and is thermally conductive.

9. The method of claim 1, wherein said base cushion is cured at a temperature up to about 205° C.

10. The method of claim 1, wherein said sleeve is removed from the mandrel by selectively cooling the mandrel.

11. The method of claim 1, wherein said sleeve is removed from the mandrel by selectively heating the replaceable fuser member.

12. The method of claim 1, wherein said topcoat layer comprises at least one material selected from the group consisting of thermoplastic fluorocarbon polymers and thermoplastic fluorocarbon random copolymers.

13. The method of claim 12, wherein said topcoat layer is a thermoplastic fluorocarbon random copolymer containing a bisphenol curing agent residue, a particulate filler containing zinc oxide and an aminosiloxane.

14. The method of claim 12, wherein said topcoat layer is a thermoplastic fluorocarbon random copolymer containing a bisphenol curing agent residue, a particulate filler containing zinc oxide, an aminosiloxane and antimony-doped tin oxide particles.

15. The method of claim 1, wherein said sleeve is of the same material as the machine mandrel.

16. The method of claim 1, wherein said mandrel comprises at least one of high temperature nickel, carbon steel and copper/zinc alloys.

17. The method of claim 5, wherein said sleeve is of the same material as the machine mandrel.

18. The method of claim 5, wherein said mandrel comprises at least one of high temperature nickel, carbon steel and copper/zinc alloys.

19. The method of claim 5, wherein said mandrel has a coefficient of thermal expansion equal to from 90 to 110% of the coefficient of thermal expansion of the sleeve.

* * * * *